US006966966B2

(12) United States Patent
Koizumi et al.

(10) Patent No.: US 6,966,966 B2
(45) Date of Patent: Nov. 22, 2005

(54) PROTECTIVE SHEET PEELING DEVICE AND PROTECTIVE SHEET PEELING METHOD

(75) Inventors: Takashi Koizumi, Kanagawa (JP); Yoshinori Kawamura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 45 days.

(21) Appl. No.: 10/728,913

(22) Filed: Dec. 8, 2003

(65) Prior Publication Data

US 2004/0112534 A1 Jun. 17, 2004

(30) Foreign Application Priority Data

Dec. 10, 2002 (JP) ..... 2002-358286

(51) Int. Cl.[7] ..... B32B 35/00

(52) U.S. Cl. ..... 156/344; 156/584; 271/281; 271/285

(58) Field of Search ..... 430/253, 256, 430/257, 258, 259, 260, 261, 262; 156/344, 156/584; 271/280, 281, 285

(56) References Cited

U.S. PATENT DOCUMENTS 3,266,797 A * 8/1966 Stievenart ..... 271/285
3,297,317 A * 1/1967 Stievenart ..... 271/281
3,537,703 A * 11/1970 Blow, Jr. ..... 271/281
3,684,278 A * 8/1972 Takahaski ..... 271/281
5,108,534 A * 4/1992 Tveit et al. ..... 156/344
5,141,584 A * 8/1992 Schuh et al. ..... 156/344
5,169,474 A * 12/1992 Binder ..... 156/344
5,478,428 A * 12/1995 Carpenter ..... 156/344
5,520,776 A * 5/1996 Van Allen et al. ..... 156/584
5,843,276 A * 12/1998 Watanabe ..... 156/584

FOREIGN PATENT DOCUMENTS

EP 0 479 690 A1 4/1992
JP 2000-247489 A 9/2000

OTHER PUBLICATIONS

Japanese Abstract No. 2000109266, dated Apr. 18, 2000.
Japanese Abstract No. 60061458, dated Apr. 9, 1985.
Japanese Abstract No. 10167560, dated Jun. 23, 1998.

* cited by examiner

*Primary Examiner*—Mark A. Osele
(74) *Attorney, Agent, or Firm*—Sughrue Mion, PLLC

(57) ABSTRACT

A protective sheet peeling device which reliably separates, from a sheet, a protective sheet (an interleaf sheet) which is superposed with one surface of the sheet. A free roller is disposed at a downstream side of a conveying roller of a peeling section, in a state in which one portion of the free roller is disposed on an "imaginary conveying locus" of a printing plate precursor. Further, a displacement roller is disposed at a downstream side of the free roller. After the printing plate precursor, which is superposed with the interleaf sheet, has passed by the free roller, when the displacement roller moves to a position of reaching the "imaginary conveying locus", the printing plate precursor and the interleaf sheet are curved along the free roller. Due to reverse rotation of the displacement roller, the interleaf sheet is peeled off of the printing plate precursor.

19 Claims, 5 Drawing Sheets

PROTECTIVE SHEET PEELING DEVICE AND PROTECTIVE SHEET PEELING METHOD

CROSS-REFERENCE TO RELATED APPLICATION

This application claims priority under 35 USC 119 from Japanese Patent Application No. 2002-358286.

BACKGROUND OF THE INVENTION

1. Field of the Invention

The present invention relates to a protective sheet peeling device and a protective sheet peeling method which peel-off and separate a protective sheet from a sheet at the time when the sheet, on whose one surface the protective sheet is superposed and which is removed together with the protective sheet, is conveyed and supplied to a subsequent process.

2. Description of the Related Art

A technique (printing plate exposing device) has come to be developed which, by using a printing plate precursor (hereinafter called "printing plate") in which a recording layer (photosensitive layer) is provided on a support (e.g., a PS plate, a thermal plate, a photopolymer plate, or the like), records an image directly by a laser beam or the like onto the photosensitive layer of the printing plate. With such a technique, it is possible to quickly record an image onto a printing plate.

Here, in an automatic printing plate exposing device using a technique of recording an image onto a printing plate, a large number of printing plates are stacked and accommodated within a cassette. The image forming surface of the printing plate is easily scratched. In order to protect the image forming surfaces, protective sheets (interleaf sheets) are superposed on the image forming surfaces of the printing plates. The printing plates and the protective sheets are successively stacked in layers and accommodated within the cassette. At the time when a printing plate is to be removed from the cassette, the uppermost printing plate among the plural printing plates stacked within the cassette is sucked by suction cups and separated from the other printing plates. That uppermost printing plate is singly removed (the printing plates are removed one-by-one), and while being inverted, is fed (conveyed and supplied) to a subsequent process (e.g., an exposure section) (see, for example, Japanese Patent Application Laid-Open (JP-A) No. 2000-247489).

When the printing plates are removed one-by-one from the cassette and conveyed and supplied to the subsequent process as described above, the protective sheet must of course be peeled off (separated) from the printing plate, such that only the printing plate is conveyed and supplied to the next process which is the exposure process or the like.

In this case, conventionally, for example, suction cups used exclusively for sucking the protective sheet were provided, and the protective sheet was sucked by these exclusive suction cups and peeled off (separated) from the printing plate. Or, a fan for sucking of the protective sheet was provided along the conveying path of the printing plate conveyed together with the protective sheet, and the protective sheet was sucked by the fan and separated from the printing plate.

However, in such conventional protective sheet peeling (separating) structures, in both cases, the structure is complex and the device becomes large. There is therefore room for improvement with regard to the points of ensuring the stability of and shortening the processing time for the peeling off of the protective sheet.

SUMMARY OF THE INVENTION

In view of the aforementioned, the present invention provides a protective sheet peeling device which, at the time when a sheet (sheet body), on whose one surface a protective sheet is superposed and which is removed together with the protective sheet, is conveyed and supplied to a subsequent process, can stably and reliably peel off and separate the protective sheet from the sheet in a state in which they are being conveyed (are traveling), and which can realize this with a simple structure.

One aspect of the present invention is a protective sheet peeling device which separates a protective sheet which is superposed with a sheet, the device comprising: a conveying mechanism conveying the sheet and the protective sheet, which is superposed with one surface of the sheet, in a superposed state in a predetermined conveying direction along a predetermined path; a free roller disposed so as to be freely rotatable at a downstream side, in the conveying direction, of the conveying mechanism, the free roller thereby curving conveying of the sheet and the protective sheet toward a protective sheet side; and a displacement roller provided at a downstream side, in the conveying direction, of the free roller at a side of the predetermined path which side corresponds to the protective sheet which is being conveyed, and movable between a position at which a surface of the displacement roller reaches the path and a position at which the surface of the displacement roller is withdrawn from the path, and rotating in a direction opposite to the conveying direction, wherein, after a leading end of at least one of the sheet and the protective sheet passes by the free roller, the displacement roller is moved to the position at which the surface of the displacement roller reaches the path, and the sheet and the protective sheet are partly curved along the free roller, and the protective sheet is thereby peeled off from the sheet.

Another aspect of the present invention is a protective sheet peeling method which separates, from a sheet which is being conveyed, a protective sheet which is superposed with one surface of the sheet, the method comprising the steps of: conveying the sheet and the protective sheet, which is superposed with the one surface of the sheet, in a first direction along a predetermined conveying path; curving, toward a protective sheet side and along a portion of a first roller of which one portion is set on the predetermined conveying path, the sheet and the protective sheet which have been conveyed in; after a leading end of at least one of the sheet and the protective sheet passes by the first roller, making a second roller, which rotates in a direction opposite the first direction, abut the sheet and the protective sheet from a protective sheet side, thereby applying conveying force in the direction opposite the first direction to the protective sheet and peeling and protective sheet from the sheet; and conveying the peeled-off protective sheet along a path which is forked-off from the predetermined conveying path.

Yet another aspect of the present invention is a protective sheet peeling device which, at a time when a sheet, which is removed together with a protective sheet superposed with one surface of the sheet, is conveyed in order to be supplied to a subsequent process section, peels off and separates the protective sheet from the sheet, the device comprising: a conveying roller provided at a side of the one surface of the sheet which is being conveyed, and conveying the sheet and the protective sheet toward the subsequent process section by being driven to rotate; a free roller provided so as to correspond to a side of another surface of the sheet which is conveyed downstream of the conveying roller, and disposed in a state in which one portion of the free roller is on a predetermined conveying locus of the sheet, and rotating freely; and a displacement roller provided so as to correspond to the side of the one surface of the sheet which is conveyed downstream of the free roller, and able to move between a state of arriving on the predetermined conveying locus and a state of being withdrawn from the predetermined conveying locus, and being driven to rotate in a direction opposite a rotating direction of the conveying roller, wherein, after the sheet and the protective sheet have passed by the free roller, the displacement roller is moved onto the predetermined conveying locus, and thereby, while the sheet and the protective sheet are being forcibly curved along the free roller, the protective sheet is peeled off from the sheet by rotation of the displacement roller in the opposite direction.

In the protective sheet peeling device of the above-described aspect, the conveying roller and the displacement roller are disposed at one surface side of the sheet (the side of the protective sheet superposed therewith), with respect to a predetermined conveying locus of the sheet which is being conveyed and supplied. The free roller is disposed at the other surface side.

Here, when the sheet is conveyed and supplied to the subsequent process, the displacement roller is in a state of being withdrawn from the predetermined conveying locus, and the sheet (and the protective sheet) are successively conveyed by the conveying roller. (In this case, the sheet and the protective sheet which have reached the free roller are conveyed while being slightly curved by the free roller. However, because the displacement roller is withdrawn, it does not impede the conveying. Moreover, the surface of the sheet which contacts the free roller is the reverse surface of the sheet (i.e., the surface of the sheet at the side opposite the protective sheet). Therefore, there are no problems even if the sheet contacts the free roller.)

After the sheet and the protective sheet have passed by the free roller and the displacement roller and reached a predetermined position, the displacement roller is moved onto the predetermined conveying locus. In this way, the sheet and the protective sheet are forcibly curved along the free roller. Further, at this time, the sheet receives the application of the reverse direction driving rotation of the displacement roller. In this way, as the displacement roller rotates, the protective sheet is peeled off and separated from the sheet, and only the sheet is conveyed and supplied as is to the subsequent process.

The protective sheet peeling device of the above-described aspect can peel off and separate the protective sheet from the sheet with the simple structure in which the free roller and the displacement roller are provided so as to correspond to the conveying locus of the sheet and the displacement roller is moved at a predetermined time. Further, this is not a structure which requires a special processing time for peeling off (separating) the protective sheet. The protective sheet can be peeled off (separated) at a point in time during the conveying of the sheet which is of course required. In other words, the processing for peeling off (separating) the protective sheet can be carried out synchronously with (proceed simultaneously with) the conveying and supplying of the sheet. Therefore, the overall processing time can be shortened, and the produceability can be improved. In addition, it is possible to peel off (separate) the protective sheet for protecting the sheet, immediately before the subsequent step. In other words, the sheet is conveyed with the protective sheet superposed thereon as is until reaching the immediate vicinity of, for example, an exposure section which is the subsequent process. Therefore, unnecessary damage to the protected surface (exposure surface) of the sheet can be prevented in advance.

As described above, in the protective sheet peeling device relating to the above-described aspect, at the time when a sheet, on whose one surface a protective sheet is superposed and which has been removed together with the protective sheet, is conveyed and supplied to a subsequent process, the protective sheet can be stably and reliably peeled off and separated from the sheet, and this can be realized with a simple structure.

In the protective sheet peeling device of the above-described aspect, as a new feature, a finned portion, which is formed of rubber and at which convex and concave portions are continuous along a peripheral direction, may be formed at a peripheral surface of the displacement roller.

In the protective sheet peeling device having the above-described new feature, a finned portion, which is formed of rubber and at which convex and concave portions are continuous, is formed at the peripheral surface of the displacement roller. Therefore, it is difficult for so-called "paper dust", which is generated due to the displacement roller contacting protective sheets a large number of times, to collect at the peripheral surface of the displacement roller. Accordingly, the original characteristics of the peripheral surface of the displacement roller (e.g., the friction characteristic, the elasticity, and the like) can be maintained over a long period of time, and the ability to peel off (separate) the protective sheet can be ensured.

Moreover, the protective sheet peeling device of the above-described aspect may have another feature of being provided with a conveying belt which nips and conveys the protective sheet which has been peeled off from the sheet by the displacement roller.

This protective sheet peeling device having the above-described other feature is provided with the conveying belt which nips and conveys the protective sheet which has been peeled off from the sheet. Therefore, even if the protective sheet is a thin sheet, it does not get stuck (so-called "jamming" does not arise), and the peeled-off protective sheet can be stably and reliably conveyed.

DETAILED DESCRIPTION OF THE INVENTION

Figure 1:
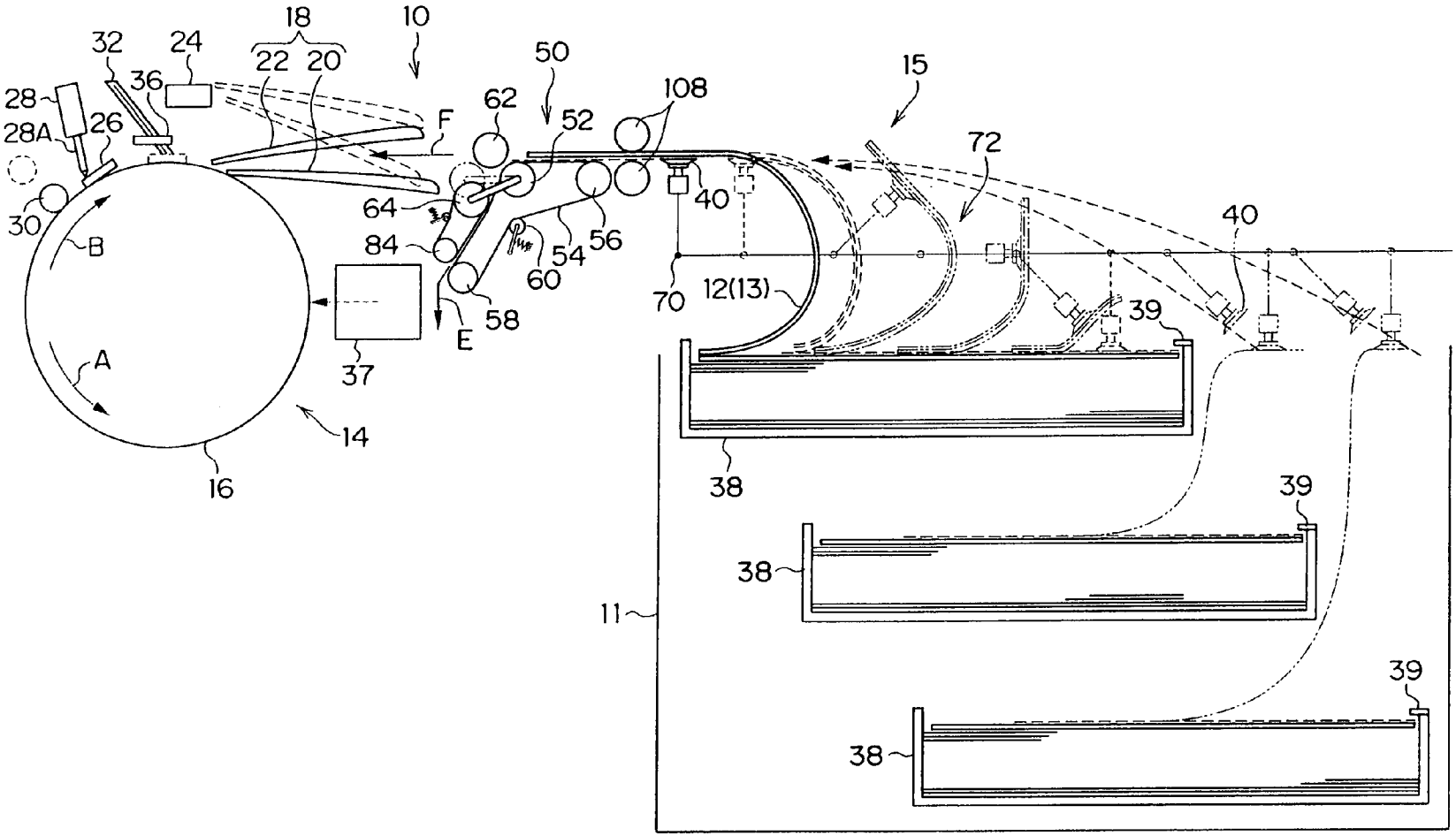
FIG. 1 is a schematic diagram of an automatic printing plate exposing device to which an interleaf sheet peeling portion relating to an embodiment of the present invention is applied.

The schematic overall structure of an automatic printing plate exposing device 10, to which a protective sheet peeling device relating to an embodiment of the present invention is applied, is shown in FIG. 1.

The automatic printing plate exposing device 10 is divided into two main sections which are an exposure section 14, which irradiates a light beam onto an image forming layer of a printing plate 12 so as to expose an image, and a removing/conveying section 15 which removes the printing plate 12 one-by-one and conveys the printing plate 12 to the exposure section 14. The printing plate 12, which has been subjected to exposure processing by the automatic printing plate exposing device 10, is fed out to a developing device (not illustrated) which is disposed adjacent to the automatic printing plate exposing device 10.

[Structure of Exposure Section 14]

The exposure section 14 is structured such that a rotating drum 16, around whose peripheral surface the printing plate 12 is trained and held, is the main portion of the exposure section 14. The printing plate 12 is guided by a conveying guide unit 18, and is fed in from a direction tangent to the rotating drum 16. The conveying guide unit 18 is structured by a plate supplying guide 20 and a plate discharging guide 22.

The relative positional relationship of the plate supplying guide 20 and the plate discharging guide 22 of the conveying guide unit 18 is such that the plate supplying guide 20 and the plate discharging guide 22 form a sideways V shape. The plate supplying guide 20 and the plate discharging guide 22 rotate by predetermined angles around the right end portion sides thereof in FIG. 1. Due to this rotation, the plate supplying guide 20 can be selectively disposed at a position corresponding to the rotating drum 16 (a position of being disposed in a direction tangent to the rotating drum 16), and a position in a direction of inserting the printing plate 12 into a puncher 24 provided above the rotating drum 16. The printing plate 12 which has been fed in from the removing/conveying section 15 is first guided by the plate supplying guide 20 and fed into the puncher 24 where notches for positioning are formed in the leading end of the printing plate 12. After the printing plate 12 undergoes processing at the puncher 24 as needed, the printing plate 12 is returned to the plate supplying guide 20. The printing plate 12 is thereby moved to a position corresponding to the rotating drum 16.

The rotating drum 16 is rotated by an unillustrated driving means in a direction in which the printing plate 12 is attached and exposed (the direction of arrow A in FIG. 1), and in a direction in which the printing plate 12 is removed (the direction of arrow B in FIG. 1) which is opposite to the attaching/exposing direction.

Leading end chucks 26 are attached to predetermined positions of the outer peripheral surface of the rotating drum 16. At the exposure section 14, when the printing plate 12 is to be attached to the rotating drum 16, first, the rotating drum 16 is stopped at a position (printing plate attaching position) at which the leading end chucks 26 oppose the leading end of the printing plate 12 which has been fed in by the plate supplying guide 20 of the conveying guide unit 18.

An attaching unit 28 is provided in the exposure section 14 so as to oppose the leading end chucks 26 at the printing plate attaching position. Due to extending/retracting rods 28A of the attaching unit 28 extending and one end sides of the leading end chucks 26 being pushed, the printing plate 12 can be inserted between the leading end chucks 26 and the peripheral surface of the rotating drum 16. In the state in which the leading end of the printing plate 12 is inserted between the leading end chucks 26 and the rotating drum 16, the extending/retracting rods 28A of the attaching unit 28 are pulled back such that their pressing of the leading end chucks 26 is released. In this way, the leading end of the printing plate 12 is nipped and held between the leading end chucks 26 and the peripheral surface of the rotating drum 16. Note that, at this time, the printing plate 12 is positioned due to the leading end thereof abutting positioning pins (not shown) provided on the rotating drum 16. When the leading end of the printing plate 12 is fixed to the rotating drum 16, the rotating drum 16 is rotated in the attaching/exposing direction. In this way, the printing plate 12, which has been fed in from the plate supplying guide 20 of the conveying guide unit 18, is trained about the peripheral surface of the rotating drum 16.

A squeeze roller 30 is provided at the downstream side, in the attaching/exposing direction (the direction of arrow A in FIG. 1), of the printing plate attaching position, in a vicinity of the peripheral surface of the rotating drum 16. Due to the squeeze roller 30 moving toward the rotating drum 16, the printing plate 12 which is trained on the rotating drum 16 is pushed toward the rotating drum 16 and can be made to fit tightly to the peripheral surface of the rotating drum 16.

Further, a trailing end chuck attaching/removing unit 32 is disposed in the exposure section 14 in a vicinity of the upstream side of the leading end chucks 26 in the attaching/exposing direction of the rotating drum 16. At the trailing end chuck attaching/removing unit 32, trailing end chucks 36 move along guides which are projected toward the rotating drum 16. When the trailing end of the printing plate 12 which is trained on the rotating drum 16 opposes the trailing end chuck attaching/removing unit 32, the trailing end chucks 36 are moved toward the rotating drum 16 and are attached to predetermined positions of the rotating drum 16. In this way, the trailing end of the printing plate 12 is nipped and held between the trailing end chucks 36 and the rotating drum 16.

When the leading end and the trailing end of the printing plate 12 are held at the rotating drum 16, the squeeze roller 30 is moved away (refer to the chain line in FIG. 1). Thereafter, in the exposure section 14, while rotating the rotating drum 16 at high speed at a predetermined rotational speed, a light beam, which is modulated on the basis of image data, is irradiated from a recording head portion 37 synchronously with the rotation of the rotating drum 16. In this way, the printing plate 12 is scan-exposed on the basis of the image data.

When the scan-exposure of the printing plate 12 has been completed, the rotating drum 16 is temporarily stopped at a position at which the trailing end chucks 36, which are holding the trailing end of the printing plate 12, oppose the trailing end chuck attaching/removing unit 32. The trailing end chuck attaching/removing unit 32 removes the trailing end chucks 36 from the rotating drum 16. In this way, the trailing end of the printing plate 12 is freed. Thereafter, by rotating the rotating drum 16 in the direction of removing the printing plate 12, the printing plate 12 is expelled, from the trailing end side thereof, to the plate discharging guide 22 of the conveying guide unit 18 along a direction tangent to the rotating drum 16. Thereafter, the printing plate 12 is conveyed to the developing device which is the subsequent process.

[Structure of Removing/Conveying Section 15]

Figure 5:
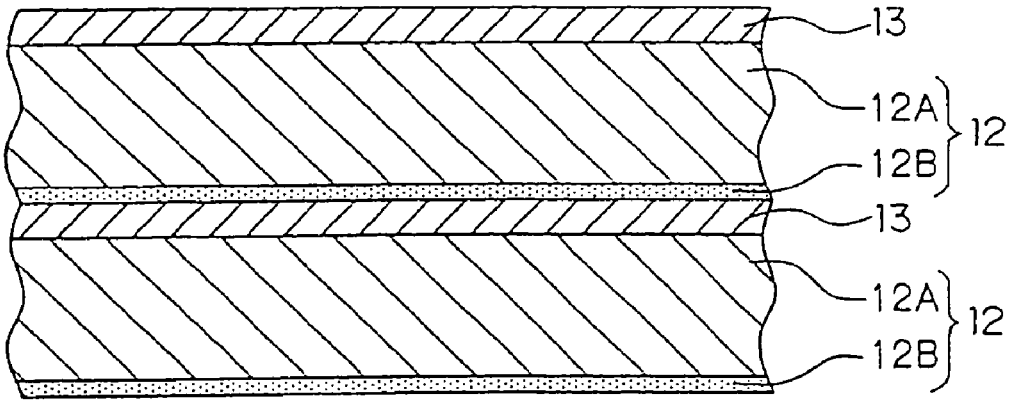
FIG. 5 is a side view showing a state in which interleaf sheets and printing plates are stacked within a cassette relating to the embodiment of the present invention.

As shown in FIG. 1, a cassette stocker portion 11 occupying a predetermined space is provided in the removing/conveying section 15. Cassettes 38, which are parallel to the surface on which the automatic printing plate exposing device 10 is placed, are provided in the cassette stocker portion 11. A plurality of the cassettes 38 are provided one above the other in plural levels. A plurality of the printing plates 12 are accommodated in each of the cassettes 38. As shown in FIG. 5, the printing plate 12 is structured such that an emulsion surface 12B (image recording surface) is formed on a support 12A. Interleaf sheets 13, which serve as protective sheets for protecting the emulsion surfaces 12B of the printing plates 12, and the printing plates 12, which are disposed such that their emulsion surfaces 12B are facing downward, are stacked and accommodated alternately in the cassette 38.

The cassettes 38 in the present embodiment are disposed one above the other in a state of being offset from one another in the horizontal direction. The amounts of offset are set on the basis of the loci of movement at the time when the printing plates 12 (and the interleaf sheets 13 which are the protective sheets) are carried out from the cassettes 38 by suction cups 40 which will be described later.

In the removing/conveying section 15, a plurality of the suction cups 40 are disposed at predetermined pitch intervals along the transverse direction of the printing plate 12. A moving mechanism 72 is provided above the cassettes 38. In the moving mechanism 72, the suction cups 40 are supported so as to hang downward, and base points 70, which support the suction cups 40 in this downward hanging state, are movable substantially horizontally in the left/right direction of the cassettes 38 in FIG. 1. The moving mechanism 72 is a structure for moving the suction cups 40 in the horizontal direction while inverting the suction cups 40. The base points 70 which support the plural suction cups 40 are rotatable.

When the printing plate 12 is to be carried out from the cassette 38 by the suction cups 40, because the interleaf sheets 13 and the printing plates 12, whose emulsion surfaces 12B are facing downward, are stacked alternately in the cassette 38, the suction cups 40 contact the interleaf sheet 13 which is the topmost layer within the cassette 38. When suction force is imparted to the suction cups 40 at the point in time when they contact the uppermost interleaf sheet 13, the suction force is applied to the uppermost interleaf sheet 13, and is transferred as well as to the printing plate 12 immediately therebeneath. The interleaf sheet 13 and the printing plate 12 are thereby sucked and lifted up (together and simultaneously) as a pair (as one set). Although the raising and lowering of the suction cups 40 is omitted from illustration in FIG. 1, the suction cups 40 are lowered to the heightwise position of each cassette 38, and separate (disjoin) the interleaf sheet 13 and the printing plate 12, which are other than and which are beneath the interleaf sheet 13 and the printing plate 12 which are being sucked, due to the sucked interleaf sheet 13 and printing plate 12 engaging with (riding over) a separating plate 39. The suction cups 40 are raised to their topmost positions in this state.

At this time, in the vertical direction lifting out of the printing plates 12 from the cassettes 38 of the respective levels, there are different loci of movement due to the lengths (left/right direction lengths in FIG. 1) of the printing plates 12. Namely, in a case in which three levels of the cassettes 38 are provided as in the present embodiment, when the printing plate 12 is lifted up out from the uppermost cassette 38, only the leading end portion of the printing plate 12 is lifted up. When the printing plate 12 is to be lifted up out from the middle cassette 38, about ⅔ of the printing plate 12 is lifted up. When the printing plate 12 is to be lifted up out from the lowermost cassette 38, the entire printing plate 12 is in a state of being suspended downward.

In this state, a plate supporting the suction cups 40 begins to rotate counterclockwise in FIG. 1 around the base points 70, and begins to move toward the left, in FIG. 1, of the cassettes 38. In this way, the suction points of the suction cups 40 move while tracing a so-called cycloid curve. Because the amounts of offset of the respective cassettes 38 are set on the basis of the loci of movement, regardless of which cassette 38 the interleaf sheet 13 and the printing plate 12 are lifted-out from, it is possible to lift the interleaf sheet 13 and the printing plate 12 out without them interfering with the cassettes 38 thereabove.

It is most preferable that there is absolutely no interference between the printing plate 12 and the cassettes 38 thereabove. However, the surface abutting the cassette 38 is the interleaf sheet 13 (the reverse surface side of the printing plate 12). Therefore, in consideration of the fact that the space, as seen in plan view, of the cassette stocker section 11 is made to be small, the printing plate 12 may slightly contact the cassette 38 when the suction cups 40 are moving in the left/right direction (the horizontal direction), provided that contact at the time when the suction cups 40 are being raised and lowered (being moved in the vertical direction) and are being rotated is avoided.

When the suction cups 40 have been rotated by 180°, the interleaf sheet 13 is now at the lower side and the printing plate 12 is now at the upper side in the state shown in FIG. 1, and the interleaf sheet 13 and the printing plate 12 are transferred to the conveying rollers 108.

An interleaf sheet peeling portion 50, which serves as a protective sheet peeling device, is provided at the downstream side of the conveying rollers 108.

Figure 2:
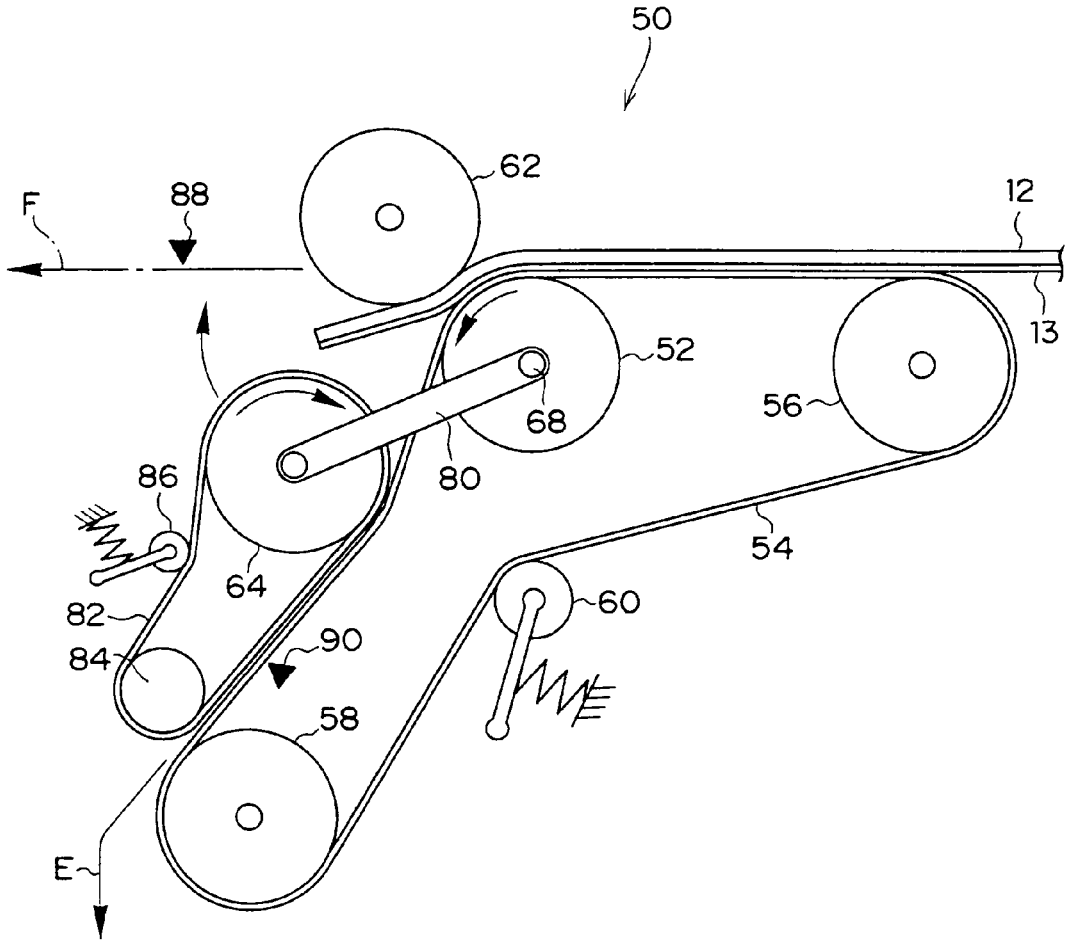
FIG. 2 is an overall structural diagram of the interleaf sheet peeling portion relating to the embodiment of the present invention.

As shown in detail in FIG. 2, a conveying roller 52 serving as a driving roller is provided at the interleaf sheet peeling portion 50. A belt 54 is trained around the conveying roller 52. The belt 54 is also trained around a roller 56 and a roller 58. In this way, the printing plate 12 (and the interleaf sheet 13) fed out from the conveying rollers 108 can be conveyed.

A tension roller 60 abuts the outer periphery of the belt 54 between the roller 56 and the roller 58, and maintains the tension of the belt 54 within a predetermined range.

A free roller 62 which rotates freely is disposed at the downstream side of the conveying roller 52. The free roller 62 is provided so as to correspond to the reverse surface side of the printing plate 12 which is being conveyed by the conveying roller 52 (i.e., so as to correspond to the side of the printing plate 12 opposite the interleaf sheet 13, which is the upper surface side in FIG. 2). Moreover, the free roller 62 is disposed in a state in which a portion thereof has entered by a predetermined amount (1 to 1.5 mm in the present embodiment) onto the locus of conveying of the printing plate 12 which is being conveyed and supplied (i.e., an imaginary locus of conveying in a case in which the free roller 62 did not exist, which hereinafter will be called the "imaginary conveying locus").

Figure 3:
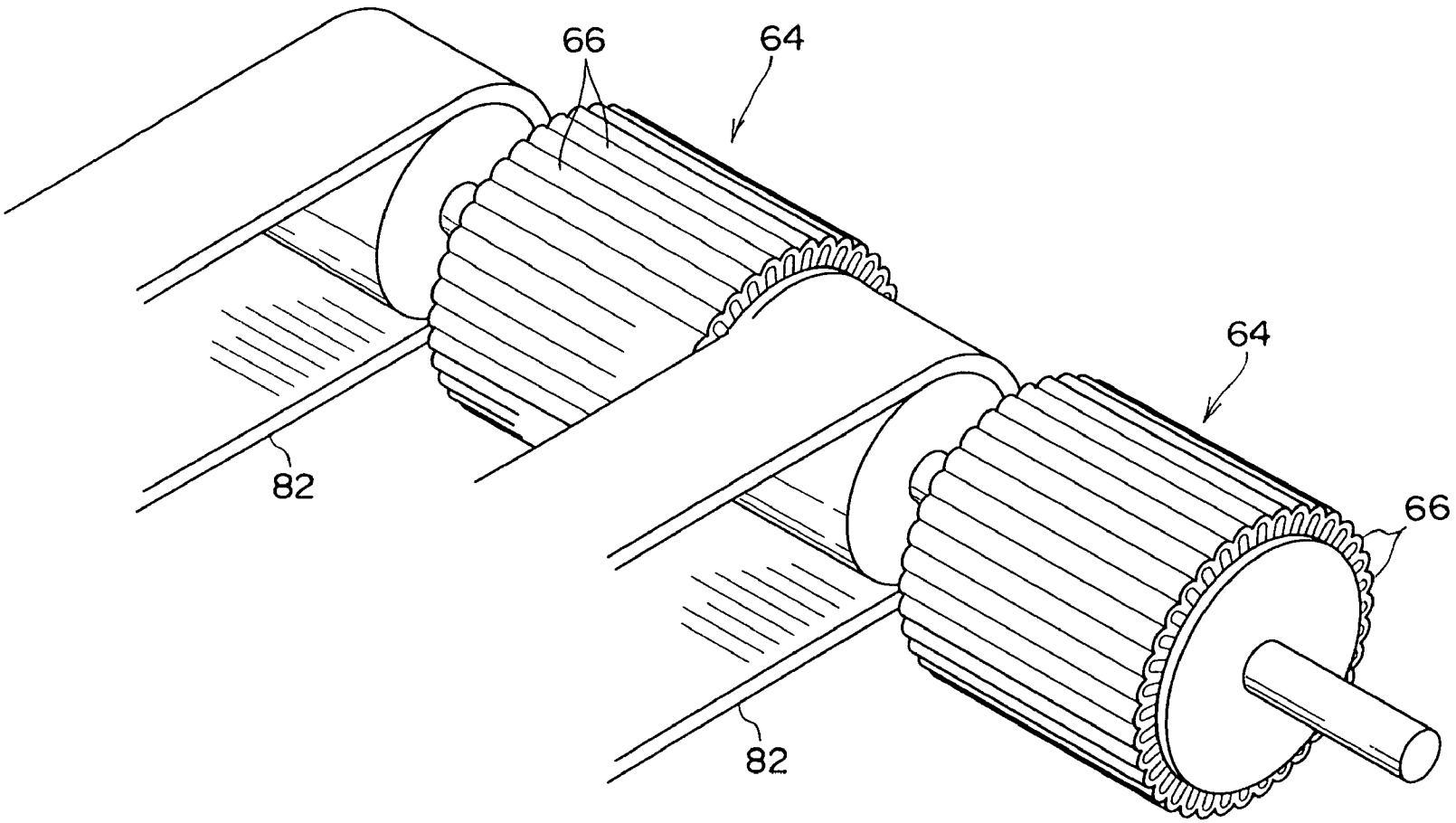
FIG. 3 is a perspective view showing details of a displacement roller of the interleaf sheet peeling portion relating to the embodiment of the present invention.

On the other hand, displacement rollers 64 serving as driving rollers are disposed at the downstream side of the free roller 62. As shown in FIG. 3, fin portions 66 formed from rubber, at which convex and concave portions are continuous along the peripheral direction, are formed at the peripheral surfaces of the displacement rollers 64 such that the displacement rollers 64 have a predetermined friction characteristic and elasticity characteristic. The displacement rollers 64 are provided so as to correspond to the obverse side of the printing plate 12 which is being conveyed by the conveying roller 52 (i.e., so as to correspond to the interleaf sheet 13 side of the printing plate 12, which is the lower surface side in FIG. 2). Moreover, the displacement rollers 64 are supported by arms 80, which are mounted to a supporting shaft 68, and can be displaced upward and downward around the supporting shaft 68 (by the arms 80). In this case, the displacement rollers 64 are movable between a state of arriving on the "imaginary conveying locus" of the printing plate 12, and a state of being withdrawn from that state. In addition, the displacement rollers 64 are structured so as to be driven to rotate in the direction opposite the rotating direction of the conveying roller 52.

In this way, after the printing plate 12 and the interleaf sheet 13 have together passed by the free roller 62, the displacement rollers 64 move onto the "imaginary conveying locus" of the printing plate 12. In this way, the interleaf sheet 13 can be peeled off from the printing plate 12 due to the aforementioned rotation in the opposite direction, while the printing plate 12 and the interleaf sheet 13 are forcibly curved along the free roller 62.

Belts 82 are trained around portions of the displacement rollers 64. The belts 82 are trained around rollers 84 as well. Tension rollers 86 abut the outer peripheries of the belts 82, and maintain the tensions of the belts 82 within a predetermined range.

A sensor 88 is provided downstream of the displacement rollers 64 (the free roller 62). The sensor 88 can detect whether or not the printing plate 12, which has been fed out from (i.e., which has passed by) the free roller 62 and the displacement rollers 64 has reached a predetermined position. In this way, the displacement rollers 64 are moved onto the "imaginary conveying locus" of the printing plate 12. Further, a sensor 90 is provided at the portion where the belt 54 and the belts 82 contact one another (i.e., at the downstream side of the displacement rollers 64 in the direction of rotation of the belts 82). The sensor 90 can detect the interleaf sheet 13 which has been peeled off from the printing plate 12 by the displacement rollers 64. In this way, the displacement rollers 64 are withdrawn (moved away) from their position on the "imaginary conveying locus" of the printing plate 12.

Next, operation of the present embodiment will be described.

In the automatic printing plate exposing device 10 having the above-described structure, when the printing plate 12 (and the interleaf sheet 13) are to be removed from the cassette 38, one of the cassettes 38 which are stacked in plural levels is specified. When the cassette 38 is specified, the suction cups 40 are positioned in a vicinity of the right end portion (in FIG. 1) of the specified cassette 38. After this positioning, the suction cups 40 are lowered to the heightwise position of the cassette 38. At this time, although the heightwise positions of the respective cassettes 38 are different, in each case, the movement of the suction cups 40 is simple, rectilinear movement.

When the suction cups 40 are lowered and contact the interleaf sheet 13 which is the uppermost material in the specified cassette 38, the sucking by the suction cups 40 is started, and in this state, the suction cups 40 are raised. During this raising, the suction cups 40 suck, together with the interleaf sheet 13 which is the topmost layer, the printing plate 12, such that the topmost interleaf sheet 13 and printing plate 12 are lifted up out of (removed from) the cassette 38.

When the suction cups 40 lift the printing plate 12 (and the interleaf sheet 13) up out from the cassette 38 and reach their topmost positions, the suction cups 40 move horizontally toward the exposure section 14 while rotating 180° around the base points 70. At this time, the printing plate 12 pick-up positions (the places sucked by the suction cups 40) move while tracing a so-called cycloid curve. Therefore, the printing plate 12 (and the interleaf sheet 13) which have been lifted up out of one of the lower-level cassettes 38 and which intrinsically have a given amount of stiffness, are conveyed while circling around the cassettes 38 thereabove. Thus, there is hardly any contact of the printing plate 12 (and the interleaf sheet 13) with the cassettes 38 thereabove. Note that, because the portion of the printing plate 12 which may contact the cassettes 38 thereabove is the reverse surface side of the printing plate 12, some contact is permitted.

The printing plate 12 (and the interleaf sheet 13) which have been rotated by 180° are transferred to the conveying rollers 108, and thereafter, are fed into the interleaf sheet peeling portion 50.

Figure 4A:
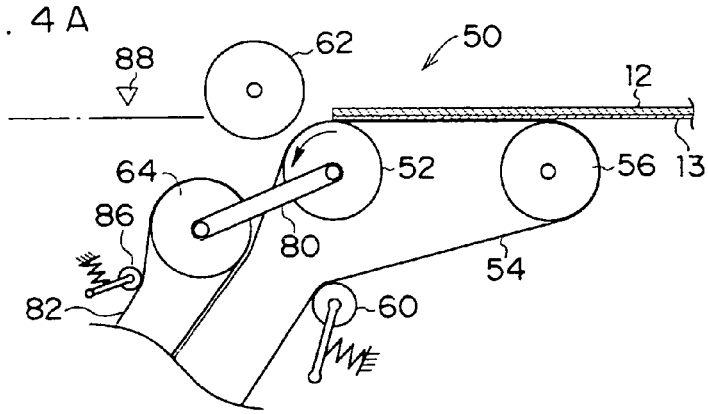
FIGS. 4A to 4D are side views corresponding to FIG. 2 and illustrating in stages the peeled state of an interleaf sheet in the interleaf sheet peeling portion relating to the embodiment of the present invention.

In the interleaf sheet peeling portion 50, as shown in FIG. 4A, the displacement rollers 64 are in a state of being withdrawn from the "imaginary conveying locus" of the printing plate 12. Therefore, the printing plate 12 and the interleaf sheet 13 are successively conveyed downstream by the conveying roller 52. In this case, the printing plate 12 and the interleaf sheet 13 which have reached the free roller 62 are conveyed while being curved slightly by the free roller 62. However, because the displacement rollers 64 are withdrawn, they do not impede the conveying. Further, because the surface of the printing plate 12 which contacts the free roller 62 is the reverse surface (the surface at the side opposite the interleaf sheet 13), there is no problem even if the printing plate 12 contacts the free roller 62.

Figure 4B:
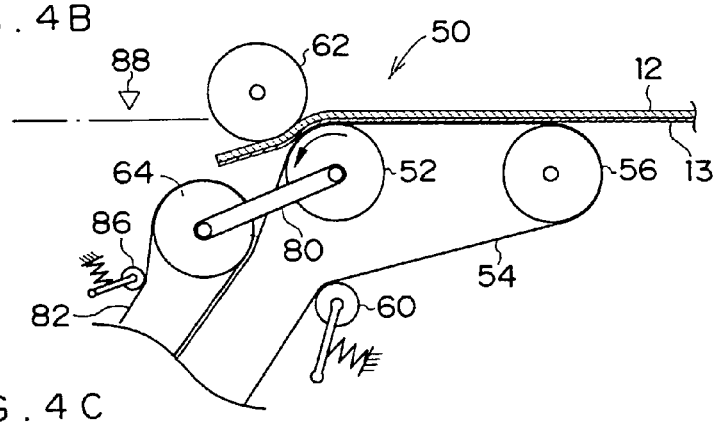
Figure 4C:
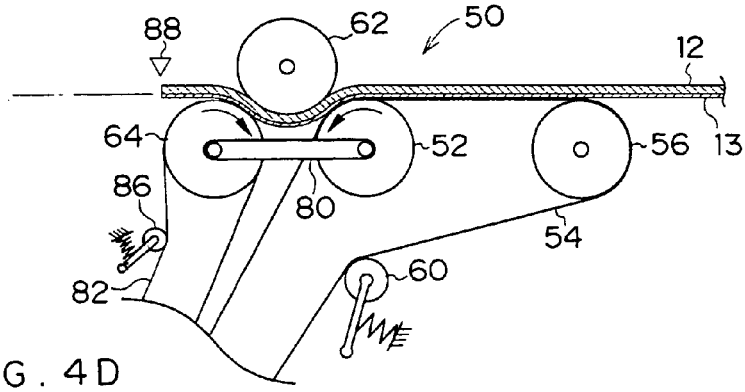
Figure 4D:
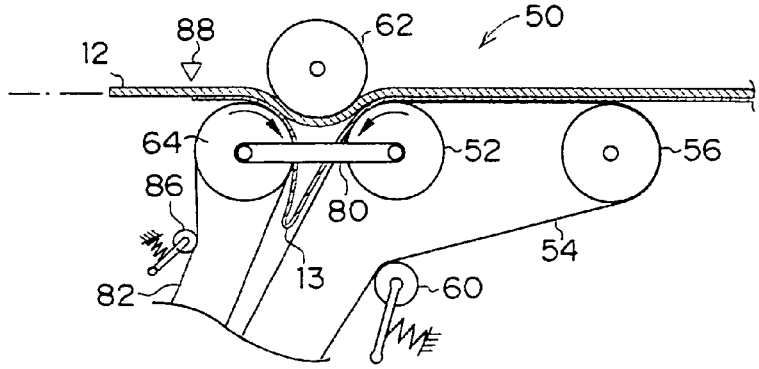

As shown in FIG. 4B, when the printing plate 12 and the interleaf sheet 13 reach a predetermined position after having passed by the free roller 62 and the displacement rollers 64, the sensor 88 detects this. On the basis of the detection signal, the supporting shaft 68 of the arms 80 is rotated, and the displacement rollers 64 are moved onto the "imaginary conveying locus" of the printing plate 12. In this way, as shown in FIG. 4C, the printing plate 12 and the interleaf sheet 13 are forcibly curved along the free roller 62. Moreover, at this time, the interleaf sheet 13 receives the application of the reverse-direction rotational driving of the displacement rollers 64. In this way, as shown in FIG. 4D, as the displacement rollers 64 rotate, the interleaf sheet 13 is peeled off from the printing plate 12. The interleaf sheet 13 which has been peeled off from the printing plate 12 is nipped between the belt 54 trained around the conveying roller 52 and the belts 82 trained around the portions of the displacement rollers 64, and is conveyed together with the driving of both belts, and is discarded in an unillustrated discard box (refer to the chain-line arrow E in FIG. 1).

Moreover, in this case, when the interleaf sheet 13 which is being nipped and conveyed between the belts reaches a predetermined position, this is detected by the sensor 90. On the basis of this detection signal, the supporting shaft 68 of the arms 80 rotates reversely such that the displacement rollers 64 are moved away (withdrawn) from the "imaginary conveying locus" of the printing plate 12, and are set in a state of standing-by for the next peeling operation.

On the other hand, the printing plate 12, from which the interleaf sheet 13 has been peeled off (separated) by the displacement rollers 64, passes by the displacement rollers 64 and is fed to the plate supplying guide 20 (refer to the solid line arrow F in FIG. 1).

The printing plate 12, which has been conveyed and supplied to the plate supplying guide 20 from the interleaf sheet peeling portion 50, is fed to the rotating drum 16. The leading end portion of the printing plate 12 is held by the leading end chucks 26. Due to the rotating drum 16 rotating in this state, the printing plate 12 is trained tightly around the peripheral surface of the rotating drum 16. Thereafter, due to the trailing end of the printing plate 12 being held by the trailing end chucks 36, preparations for exposure are completed.

In this state, image data is read, and exposure processing by the light beam from the recording head portion 37 is started. The exposure processing is so-called scan-exposure in which the recording head portion 37 is moved in the axial direction of the rotating drum 16 while the rotating drum 16 is rotated at high speed (main scanning).

When exposure processing is completed, the conveying guide unit 18 is switched (the plate discharging guide 22 is made to correspond to the rotating drum 16). Next, the printing plate 12 which is trained on the rotating drum 16 is discharged out from a direction tangent to the rotating drum 16. At this time, the printing plate 12 is fed to the plate discharging guide 22. When the printing plate 12 is fed to the plate discharging guide 22, the conveying guide unit 18 is switched such that the plate discharging guide 22 is made to correspond to the discharge opening, and the printing plate 12 is discharged. The developing section is provided in the discharging direction, and thus, the printing plate 12 is then subjected to developing processing.

Here, the interleaf sheet peeling portion 50, which, as described above, separates the interleaf sheet 13 and the printing plate 12 which have been removed from the cassette 38, peels and separates the interleaf sheet 13 from the printing plate 12 by the simple structure in which the free roller 62 and the displacement rollers 64 are provided so as to correspond to the locus of conveying of the printing plate 12 and the displacement rollers 64 are moved (displaced) at a predetermined time.

Moreover, no special processing time is required in order to peel off (separate) the interleaf sheet 13. The interleaf sheet 13 can of course be peeled off (separated) at a point in time during the necessary conveying of the printing plate 12. In other words, the peeling (separating) processing of the interleaf sheet 13 can be carried out synchronously with (can proceed simultaneously with) the conveying and supplying of the printing plate 12. Therefore, the overall processing time can be shortened, and produceability can be improved.

In addition, it is possible to peel off (separate) the interleaf sheet 13 for protecting the printing plate 12, immediately before the subsequent step (the exposure step). In other words, the printing plate 12 can be conveyed with the interleaf sheet 13 superposed thereon as is until reaching the immediate vicinity of the exposure section 14 which is the subsequent process. Therefore, unnecessary damage to the protected surface (the exposure surface) of the printing plate 12 can be prevented in advance.

Further, the fin portions 66, which are formed from rubber and at which convex and concave portions are continuous, are formed at the peripheral surfaces of the displacement rollers 64 for peeling off the interleaf sheet 13. Therefore, it is difficult for so-called "paper dust", which is generated by the displacement rollers 64 contacting the interleaf sheets 13 a large number of times, to collect at the peripheral surfaces of the displacement rollers 64. Accordingly, the original characteristics of the peripheral surfaces of the displacement rollers 64 (e.g., the friction characteristic, elasticity, and the like thereof) can be maintained over a long period of time, and the ability to peel off (separate) the interleaf sheet 13 can be ensured.

The interleaf sheet 13, which has been peeled off from the printing plate 12, is nipped between the belt 54 trained around the conveying roller 52 and the belts 82 trained around the portions of the displacement rollers 64, and is conveyed together with the driving of these belts. Therefore, even if the peeled-off interleaf sheet 13 is a thin sheet, it does not get stuck (so-called "jamming" does not occur), and the peeled-off interleaf sheet 13 can be conveyed stably and reliably.

As described above, in the interleaf sheet peeling portion 50 relating to the present embodiment, at the time when the printing plate 12, on whose one surface the interleaf sheet 13 is superposed and which has been removed together with the interleaf sheet 13, is conveyed and supplied to the exposure section 14 (the subsequent process), the interleaf sheet 13 can be stably and reliably peeled off and separated from the printing plate 12, and this can be realized by a simple structure.

As described above, the protective sheet peeling device relating to the present invention has the excellent effects that, at the time when a sheet, on whose one surface a protective sheet is superposed and which has been removed together with the protective sheet, is conveyed and supplied to a subsequent process, the protective sheet can be stably and reliably peeled off and separated from the sheet in a state in which the protective sheet and the sheet (sheet body) are being conveyed (are traveling), and this can be realized with a simple structure.

What is claimed is:

1. A protective sheet peeling device which separates a protective sheet which is superposed with a sheet, the device comprising:

a conveying mechanism conveying the sheet and the protective sheet, which is superposed with one surface of the sheet, in a superposed state in a predetermined conveying direction along a predetermined path;

a free roller disposed so as to be freely rotatable at a downstream side, in the conveying direction, of the conveying mechanism, the free roller thereby curving conveying of the sheet and the protective sheet toward a protective sheet side; and a displacement roller provided at a downstream side, in the conveying direction, of the free roller at a side of the predetermined path which side corresponds to the protective sheet which is being conveyed, and movable between a position at which a surface of the displacement roller reaches the path and a position at which the surface of the displacement roller is withdrawn from the path, and rotating in a direction opposite to the conveying direction, wherein, after a leading end of at least one of the sheet and the protective sheet passes by the free roller, the displacement roller is moved to the position at which the surface of the displacement roller reaches the path, and the sheet and the protective sheet are partly curved along the free roller, and the protective sheet is thereby peeled off from the sheet.

2. The protective sheet peeling device of claim 1, wherein the sheet is a printing plate precursor having a support and a photosensitive layer formed on the support.

3. The protective sheet peeling device of claim 1, wherein the conveying mechanism has a conveying belt which conveys the sheet and the protective sheet in the conveying direction, and the conveying belt has a surface which contacts the protective sheet and which directs the sheet and the protective sheet toward the free roller.

4. The protective sheet peeling device of claim 1, wherein the conveying mechanism has at least one conveying roller disposed so as to oppose the free roller, and the sheet and the protective sheet are curved between the conveying roller and the free roller.

5. The protective sheet peeling device of claim 1, wherein a path which is forked-off from the predetermined path is formed by the displacement roller moving to the position of reaching the predetermined path, and the protective sheet which has been separated is led to the forked-off path.

6. The protective sheet peeling device of claim 5, wherein the displacement roller has a belt which is trained around at least one portion of the displacement roller, and the belt has a surface which moves along the forked-off path.

7. The protective sheet peeling device of claim 1, wherein a portion at which convex and concave portions repeat along a peripheral direction is formed at a peripheral surface of the displacement roller, and the portion is formed of a rubber material.

8. The protective sheet peeling device of claim 1, wherein a sensor, which detects a leading end of at least one of the sheet and the protective sheet which have been conveyed in, is provided at a downstream side, in the conveying direction, of the free roller, and movement of the displacement roller is controlled on the basis of a sensing operation of the sensor.

9. A protective sheet peeling method which separates, from a sheet which is being conveyed, a protective sheet which is superposed with one surface of the sheet, the method comprising the steps of:

conveying the sheet and the protective sheet, which is superposed with the one surface of the sheet, in a first direction along a predetermined conveying path;

curving, toward a protective sheet side and along a portion of a first roller of which one portion is set on the predetermined conveying path, the sheet and the protective sheet which have been conveyed in;

after a leading end of at least one of the sheet and the protective sheet passes by the first roller, moving a second roller, which rotates in a direction opposite the first direction, from a first position to a second position to abut the protective sheet, thereby applying conveying force in the direction opposite the first direction to the protective sheet and peeling the protective sheet from the sheet; and conveying the peeled-off protective sheet along a path which is forked-off from the predetermined conveying path.

10. The protective sheet peeling method of claim 9, wherein the sheet is a printing plate precursor having a support and a photosensitive layer formed on the support.

11. A protective sheet peeling device which, at a time when a sheet, which is removed together with a protective sheet superposed with one surface of the sheet, is conveyed in order to be supplied to a subsequent process section, peels off and separates the protective sheet from the sheet, the device comprising:

a conveying roller provided at a side of the one surface of the sheet which is being conveyed, and conveying the sheet and the protective sheet toward the subsequent process section by being driven to rotate;

a free roller provided so as to correspond to a side of another surface of the sheet which is conveyed downstream of the conveying roller, and disposed in a state in which one portion of the free roller is on a predetermined conveying locus of the sheet, and rotating freely; and a displacement roller provided so as to correspond to the side of the one surface of the sheet which is conveyed downstream of the free roller, and able to move between a state of arriving on the predetermined conveying locus and a state of being withdrawn from the predetermined conveying locus, and being driven to rotate in a direction opposite a rotating direction of the conveying roller, wherein, after the sheet and the protective sheet have passed by the free roller, the displacement roller is moved onto the predetermined conveying locus, and thereby, while the sheet and the protective sheet are being forcibly curved along the free roller, the protective sheet is peeled off from the sheet by rotation of the displacement roller in the opposite direction.

12. The protective sheet peeling device of claim 11, wherein a finned portion, which is formed of rubber and at which convex and concave portions are continuous along a peripheral direction, is formed at a peripheral surface of the displacement roller.

13. The protective sheet peeling device of claim 11, further comprising a conveying belt which nips and conveys the protective sheet which has been peeled off from the sheet by the displacement roller.

14. The protective sheet peeling device of claim 11, wherein the sheet is a printing plate precursor having a support and a photosensitive layer formed on the support.

15. The protective sheet peeling device of claim 11, wherein the conveying roller has a conveying belt trained around at least one portion of the conveying roller, and the conveying belt has a surface which contacts the protective sheet and which directs the sheet and the protective sheet toward the free roller.

16. The protective sheet peeling device of claim 11, wherein the conveying roller is disposed so as to oppose the free roller, and the sheet and the protective sheet are curved between the conveying roller and the free roller.

17. The protective sheet peeling device of claim 11, wherein, due to the displacement roller moving toward a position of reaching the conveying locus, the displacement roller forms a path which is forked-off from a path heading toward the subsequent process section, and the peeled-off protective sheet is led to the forked-off path.

18. The protective sheet peeling device of claim 17, wherein the displacement roller has a belt which is trained around at least one portion of the displacement roller, and the belt has a surface which moves along the forked-off path.

19. The protective sheet peeling device of claim 11, wherein a sensor, which detects a leading end of at least one of the sheet and the protective sheet, is provided at a downstream side, in a direction in which the sheet and the protective sheet are conveyed, of the free roller, and movement of the displacement roller is controlled on the basis of a sensing operation of the sensor.

* * * * *